US011873705B1

(12) United States Patent
Almajed et al.

(10) Patent No.: US 11,873,705 B1
(45) Date of Patent: Jan. 16, 2024

(54) MULTI-STAGE FRACTURING TECHNIQUES IN OIL AND GAS

(71) Applicant: Saudi Arabian Oil Company, Dhahran (SA)

(72) Inventors: Mohammed Sameer Almajed, Alhasa (SA); Ahmed M. Alghuryafi, Udhailiyah (SA); Zuhair Mohammed Alhassan, Dhahran (SA); Nasser Mohammed Alhassan, Alhasa (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/969,968

(22) Filed: Oct. 20, 2022

(51) Int. Cl.

| | |
|---|---|
| ***E21B 33/13*** | (2006.01) |
| ***E21B 43/26*** | (2006.01) |
| ***E21B 33/134*** | (2006.01) |
| ***E21B 33/16*** | (2006.01) |

(52) U.S. Cl.
CPC ..... *E21B 43/261* (2013.01); *E21B 33/134* (2013.01); *E21B 33/165* (2020.05)

(58) Field of Classification Search
CPC ..... E21B 33/134; E21B 33/165; E21B 43/261
USPC ..... 166/281
See application file for complete search history.

(56) References Cited

U.S. PATENT DOCUMENTS

| | | | | |
|---|---|---|---|---|
| 8,047,280 | B2 | 11/2011 | Tran et al. | |
| 8,220,547 | B2 | 7/2012 | Craig et al. | |
| 9,121,251 | B2 | 9/2015 | Sommers et al. | |
| 9,121,272 | B2 * | 9/2015 | Potapenko | E21B 43/26 |
| 9,494,021 | B2 | 11/2016 | Parks et al. | |
| 10,024,132 | B2 | 7/2018 | Clemens et al. | |
| 10,053,957 | B2 * | 8/2018 | Themig | E21B 43/14 |
| 10,641,074 | B1 | 5/2020 | Alabdulmuhsin et al. | |
| 2010/0044041 | A1 * | 2/2010 | Smith | E21B 34/142 166/308.1 |
| 2016/0040492 | A1 * | 2/2016 | Vinson | E21B 23/08 166/386 |
| 2021/0017839 | A1 * | 1/2021 | Ferguson | E21B 43/119 |
| 2022/0065080 | A1 | 3/2022 | Alkhalidi | |
| 2022/0228484 | A1 | 7/2022 | Cramer | |

FOREIGN PATENT DOCUMENTS

| | | |
|---|---|---|
| CA | 2770428 | 4/2018 |
| WO | WO 2014022589 | 2/2014 |

* cited by examiner

*Primary Examiner* — Zakiya W Bates
*Assistant Examiner* — Ashish K Varma
(74) *Attorney, Agent, or Firm* — Fish & Richardson P.C.

(57) ABSTRACT

A method of fracturing a rock formation includes cementing a production pipe to a wellbore within the rock formation, wherein a seat is attached to an inner surface of the production pipe. The method further includes forming access ports along a first section of the wellbore that fluidly connect the production pipe to the wellbore, delivering treatment fluid from the production pipe to the wellbore through the access ports, flowing formation fluid from the rock formation to the production pipe through the access ports, and closing an opening in the seat to isolate the first section of the wellbore from a second section of the wellbore located above the first section.

15 Claims, 8 Drawing Sheets

MULTI-STAGE FRACTURING TECHNIQUES IN OIL AND GAS

TECHNICAL FIELD

This disclosure relates to methods of fracturing rock formations via multi-stage fracturing techniques at cemented production liners.

BACKGROUND

Producing hydrocarbons from a rock formation often requires stimulation of the rock formation, especially for rock formations of low permeability. A stimulation process may include pumping a specially designed treatment fluid into a wellbore within the rock formation at a pressure that is high enough for the treatment fluid to sufficiently infiltrate and react with the rock formation to cause a fracture in the rock formation. In some examples, consecutive stages (for example, axial sections) of the rock formation are stimulated serially in a process known as multi-stage fracturing. In a multi-stage fracturing process, each stage of the rock formation is fluidically isolated from an adjacent downhole stage while being stimulated. Commonly occurring problems in multi-stage fracturing processes include failures at isolation plugs, frac ports, and packers that are used to carry out the processes.

SUMMARY

This disclosure relates to a multi-stage fracturing process in which a cemented liner is perforated at serial zones to produce fluid within a wellbore. The cemented liner is equipped with serially arranged frac seats for accepting correspondingly-sized balls to sequentially isolate each zone. The seats are sized to allow passage of a perforating gun. Owing to the cement surrounding the liner, no packer is need to isolate the wellbore outside of the liner.

In one aspect, a method of fracturing a rock formation includes cementing a production pipe to a wellbore within the rock formation, wherein a seat is attached to an inner surface of the production pipe. The method further includes forming access ports along a first section of the wellbore that fluidly connect the production pipe to the wellbore, delivering treatment fluid from the production pipe to the wellbore through the access ports, flowing formation fluid from the rock formation to the production pipe through the access ports, and closing an opening in the seat to isolate the first section of the wellbore from a second section of the wellbore located above the first section.

Embodiments may provide one or more of the following features.

In some embodiments, the seat is positioned between the first and second sections of the wellbore.

In some embodiments, the method further includes deploying a perforation tool to the production pipe along the first section of the wellbore, activating the perforation tool to form the access ports, and withdrawing the perforation tool from the production pipe.

In some embodiments, the method further includes delivering the treatment fluid to the production pipe.

In some embodiments, the seat is a first seat, wherein a second seat is attached to the inner surface of the production pipe above the first seat, and the method further includes passing a ball through the second seat to close the opening in the first seat.

In some embodiments, the access ports are first access ports, and the method further includes forming second access ports along the second section of the wellbore that fluidly connect the production pipe to the wellbore, and delivering treatment fluid from the production pipe to the wellbore through the second access ports.

In some embodiments, the method further includes blocking the treatment fluid within the production pipe along the second section of the wellbore from moving downward through the seat.

In some embodiments, the method further includes flowing formation fluid from the rock formation to the production pipe through the second access ports.

In some embodiments, the method further includes flowing the formation fluid within the production pipe along the first and second sections of the wellbore upward to a surface of the rock formation.

In some embodiments, the method further includes flowing the ball upward from the seat to the surface.

In some embodiments, the opening is a first opening, and the method further includes closing a second opening in the second seat to isolate the second section of the wellbore from a third section of the wellbore located above the second section.

In some embodiments, the second opening is wider than the first opening.

In some embodiments, the ball is a first ball, and the method further includes closing the second opening in the second seat with the second ball.

In some embodiments, the method further includes isolating the first section from the second section without employing a packer on an outer surface of the production pipe.

In some embodiments, the method further includes isolating the first section from the second section without employing a bridge plug within the production pipe.

The details of one or more embodiments are set forth in the accompanying drawings and description. Other features, aspects, and advantages of the embodiments will become apparent from the description, drawings, and claims.

DETAILED DESCRIPTION

Figure 1:
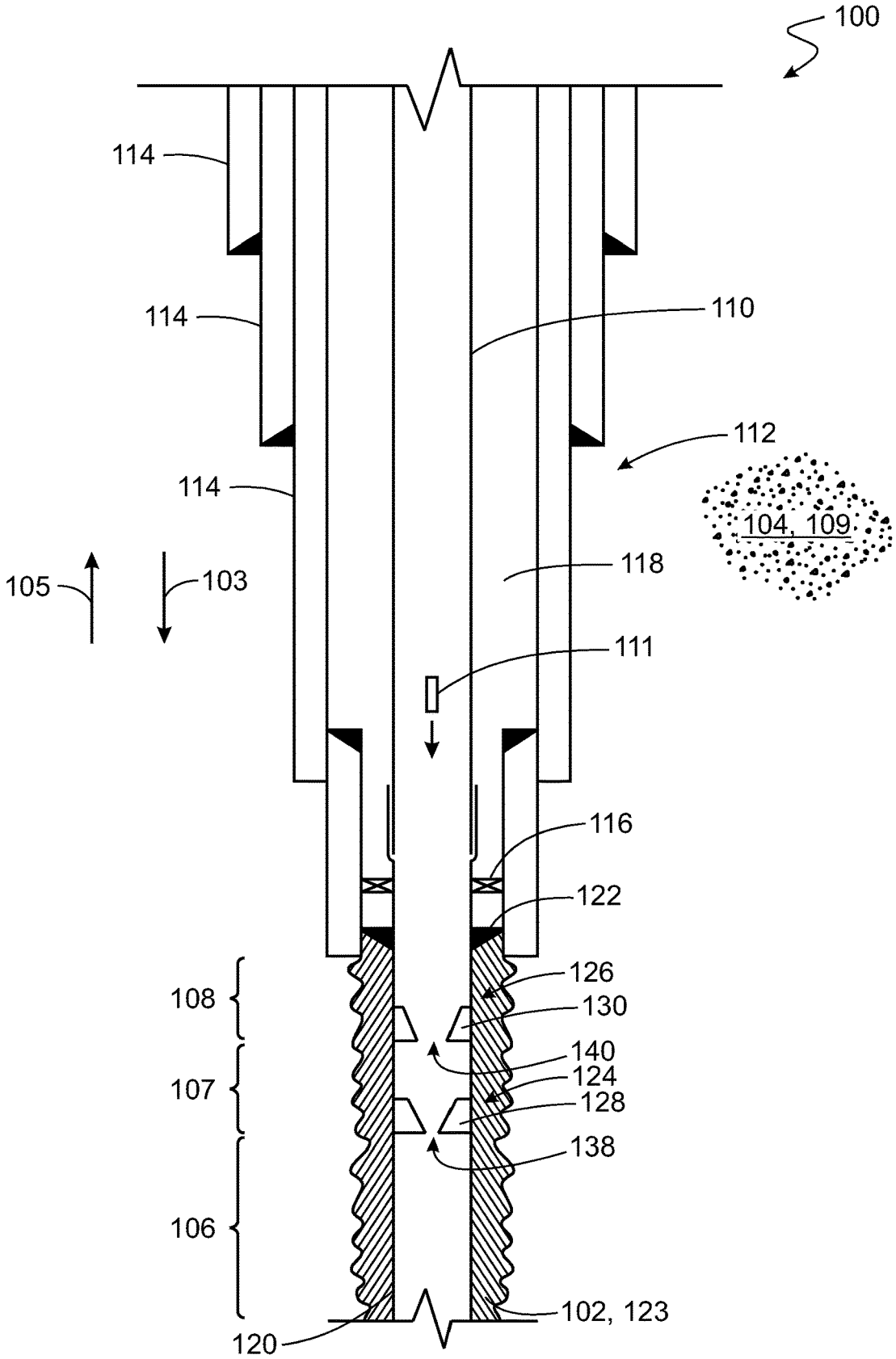
FIGS. 1-7 illustrate a series of steps included in a multi-stage fracturing process for stimulating a rock formation utilizing a well completion system at a wellbore.

FIG. 1 illustrates a well completion system 100 disposed within a wellbore 102 of a formation 104 (for example, a rock formation). The well completion system 100 is utilized for carrying out multi-stage fracturing techniques to hydraulically stimulate production of hydrocarbons from the formation 104 by delivering a treatment fluid (e.g., a stimulation fluid) to the formation 104. In the example illustration of FIG. 1, the well completion system 100 is configured for carrying out multi-stage fracturing serially at first, second, and third stages 106, 107, 108 of the formation 104.

The well completion system 100 includes a delivery tube 110 (for example, a production tubing) through which the treatment fluid can be delivered to the wellbore 102, a graduated pipe assembly 112 (for example, a casing string) disposed within the wellbore 102 and including a series of pipe segments 114 (for example, liners) for protecting the delivery tube 110, and a production packer 116 that anchors the delivery tube 110 to the pipe assembly 112 and isolates a lumen 118 of the pipe assembly 112 from the wellbore 102. The well completion system 100 further includes a production pipe 120 (for example, a production liner) that extends from the delivery tube 110 for delivering the treatment fluid to the wellbore 102 and an anchor 122 (for example, a liner hanger) by which the production pipe 120 is attached to the terminal pipe segment 114 of the pipe assembly 112. The production pipe 120 is anchored to the formation 104 with cement 123 that surrounds the production pipe 120. The production pipe 120 is sized to allow passage of a perforation tool 101 (e.g., a perforating gun) for perforating the surrounding formation 104 along the stages 106, 107, 108.

The well completion system 100 also includes isolation mechanisms 124, 126 that isolate the stages 106, 107, 108 from each other along the wellbore 102. The isolation mechanisms 124, 126 respectively include seats 128, 130 (e.g., preinstalled seats) that are attached to the production pipe 120 at fixed locations and cooperating balls 132, 134 that are introduced into the production pipe 120 to respectively land on (for example, abut) and seal complementary openings 138, 140 in the seats 128, 130. Because the isolation mechanism 124 is located downstream of the isolation mechanism 126, the ball 132 is introduced into the production pipe 120 before the ball 134 is introduced into the production pipe 120. The opening 140 has a larger diameter than does the opening 138 such that the ball 132 can pass in a downhole direction 103 through the opening 140 to contact the seat 128 for carrying out fracturing at the second stage 107 of the formation. Subsequently, the ball 134, having a larger diameter than the ball 132, is introduced into the production pipe 120 to seal (e.g., plug) the seat 130 for carrying out fracturing at the third stage 108 of the formation 104.

FIGS. 1-7 illustrate sequential steps of a process for stimulating the formation 104 at the wellbore 102. Referring to FIG. 1, the production pipe 120 is deployed to the wellbore 102 (e.g., on the delivery tube 110). Using a rig at the surface, cement 123 is then pumped in the downhole direction 103 to the wellbore 102 via a drill pipe and the production pipe 120. The cement 123 flows out of the production pipe 120 through a downhole end (not shown) and then in an uphole direction 105 behind (e.g., exteriorly to or outside of) the production pipe 120 to anchor the production pipe 120 to the formation 104. A wiper plug 111 is pumped in the downhole direction 103 through both seats 130, 128 to wipe (e.g., clean) the seats 130, 128, thereby ensuring that substantially no cement 123 remains on or otherwise obstructs the seats 130, 128. The wiper plug 111 settles at a landing base at the downhole end of the production pipe 120 (e.g., at a landing base).

Figure 2:
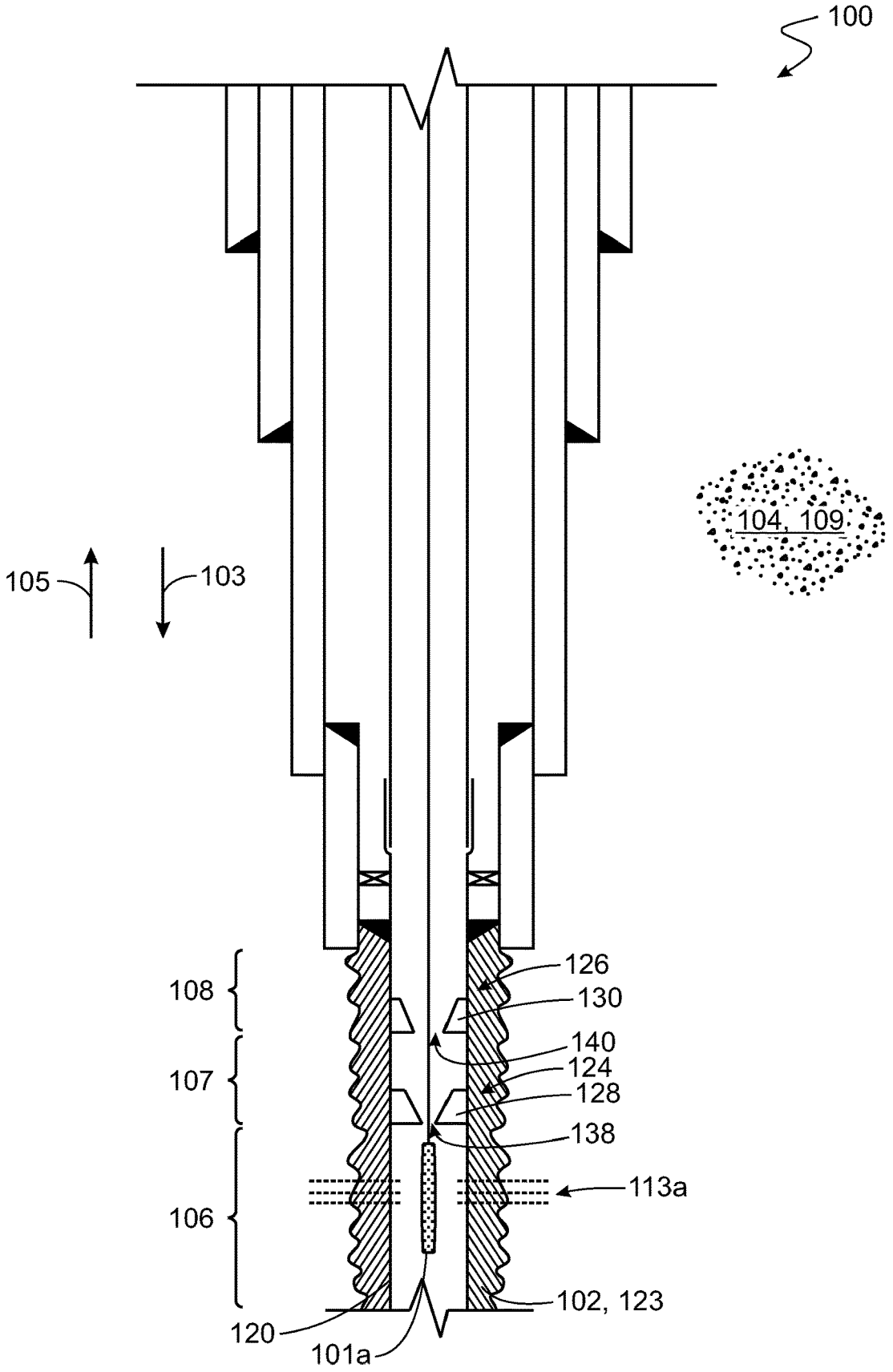

Referring to FIG. 2, once the production pipe 120 has been cemented to the formation 104 and the seats 130, 128 have been cleaned, a perforation tool 101*a* is deployed to the production pipe 120 along the first stage 106 as part of a rigless operation. In some examples, the perforation tool 101*a* may be delivered to the production pipe 120 on a wireline or coiled tubing. The perforation tool 101*a* is activated to perforate (e.g., form holes in) a wall of the production tube 120, the cement 123, and the formation 104 to form one or more access ports 113*a* (e.g., indicated by dashed lines) by which formation fluid 109 can flow into the production pipe 120 along the first stage 106. In this manner, the perforation tool 101*a* is operated to fluidically connect the production pipe 120 to the rock formation 104. The perforation tool 101*a* is then removed (e.g., withdrawn) from the production pipe 120.

Figure 3:
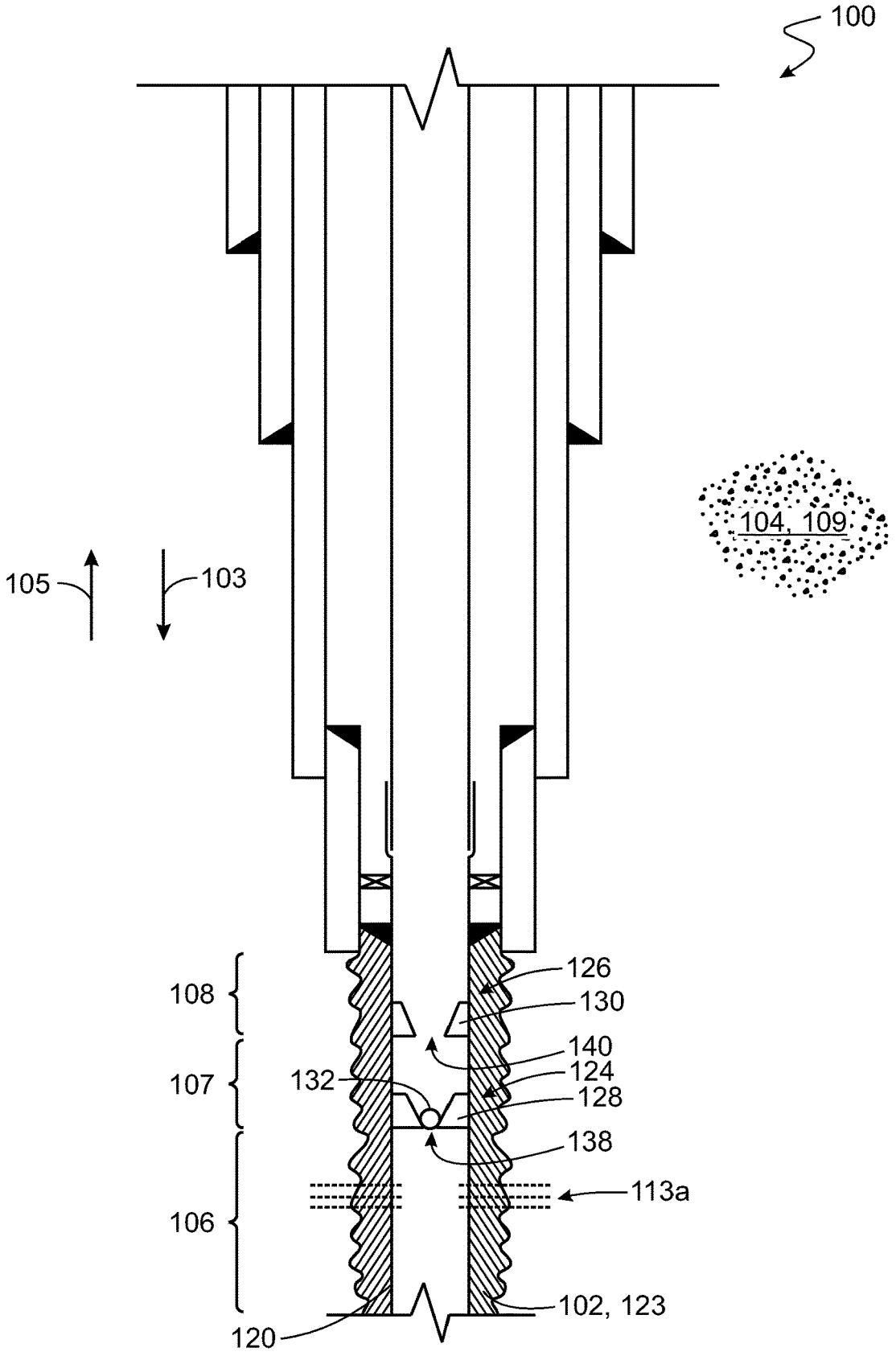

Referring to FIG. 3, treatment fluid is subsequently delivered to the production pipe 120. The treatment fluid passes through both seats 130, 128 to reach the first stage 106, where the treatment fluid enhances productivity and connectivity to the formation 104 via the access ports 113. For example, the treatment fluid can react with substances in the formation 104 to enlarge pores within the formation 104. Enlargement of the pores causes fractures in the formation 104 at which the formation fluid 109 (e.g., including hydrocarbons) can more easily flow toward the access ports 113 to be drained from the formation 104 into the production pipe 120 to substantially fill the production pipe 120 along the first stage 106. A stage such as the example first stage 106 is typically stimulated over a period of about 2 hours (h) to about 6 h, depending on a temperature within the wellbore 102, a pumping rate of the treatment fluid, and a tightness of the formation 104 with respect to permeability of the formation 104. Once stimulation of the first stage 106 has been completed, the ball 132 is delivered to the production pipe 120 to isolate the first stage 106 from the second stage 107. For example, the ball 132 passes through the seat 130 and abuts and seals the opening 138 in the seat 128. The seated ball 132 provides a barrier within the production pipe 120 between the first and second stages 106, 107.

Figure 4:
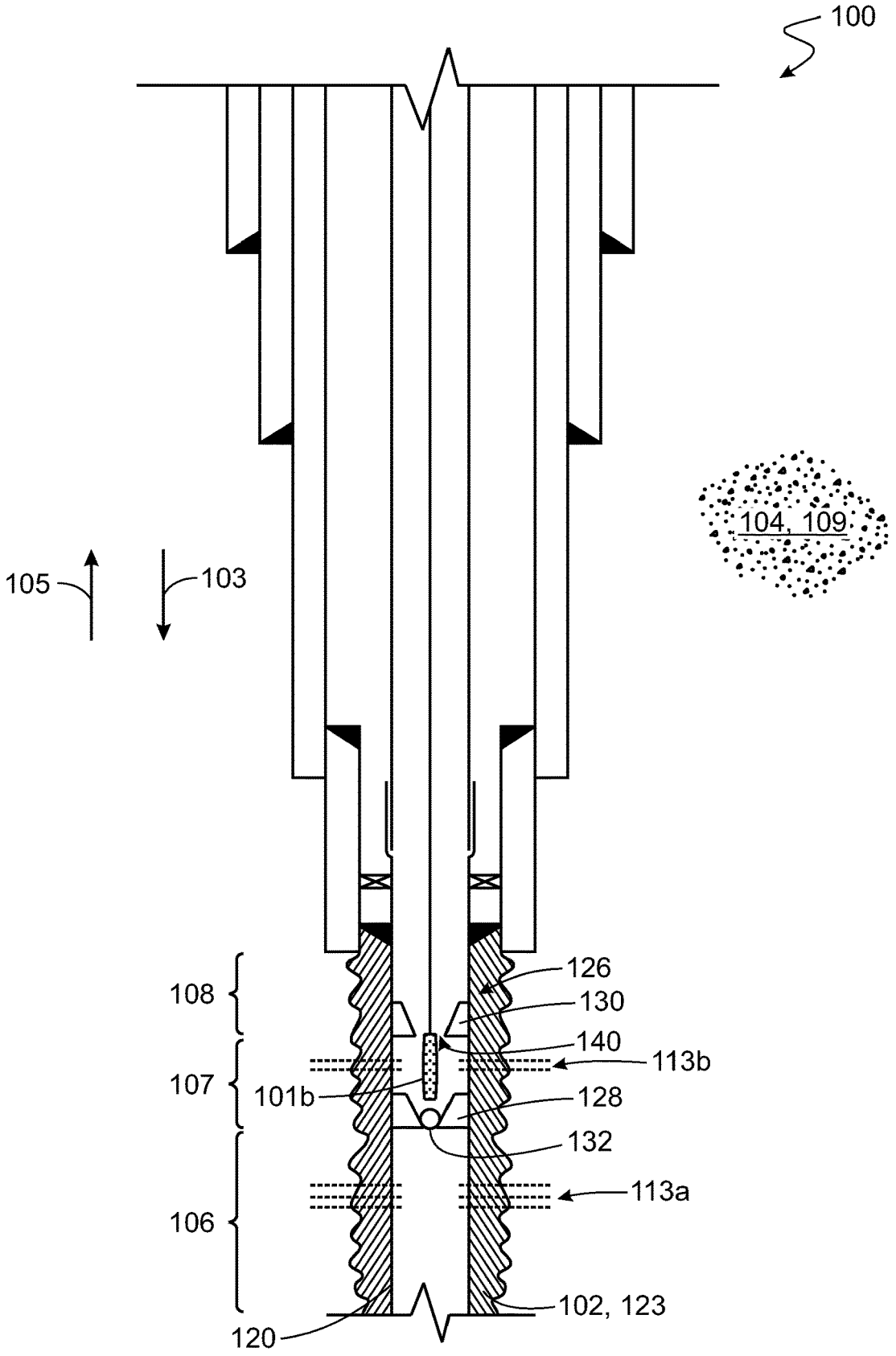

Referring to FIG. 4, stimulation of the second stage 107 can begin. A perforation tool 101*b* may be delivered to the production pipe 120 on a wireline or coiled tubing. The perforation tool 101*b* is activated to perforate (e.g., form holes in) the wall of the production tube 120, the cement 123, and the formation 104 to form one or more access ports 113*b* (e.g., indicated by dashed lines) by which formation fluid 109 can flow into the production pipe 120 along the second stage 107. In this manner, the perforation tool 101*b* is operated to fluidically connect the production pipe 120 to the rock formation 104. The perforation tool 101*b* is then removed (e.g., withdrawn) from the production pipe 120.

Figure 5:
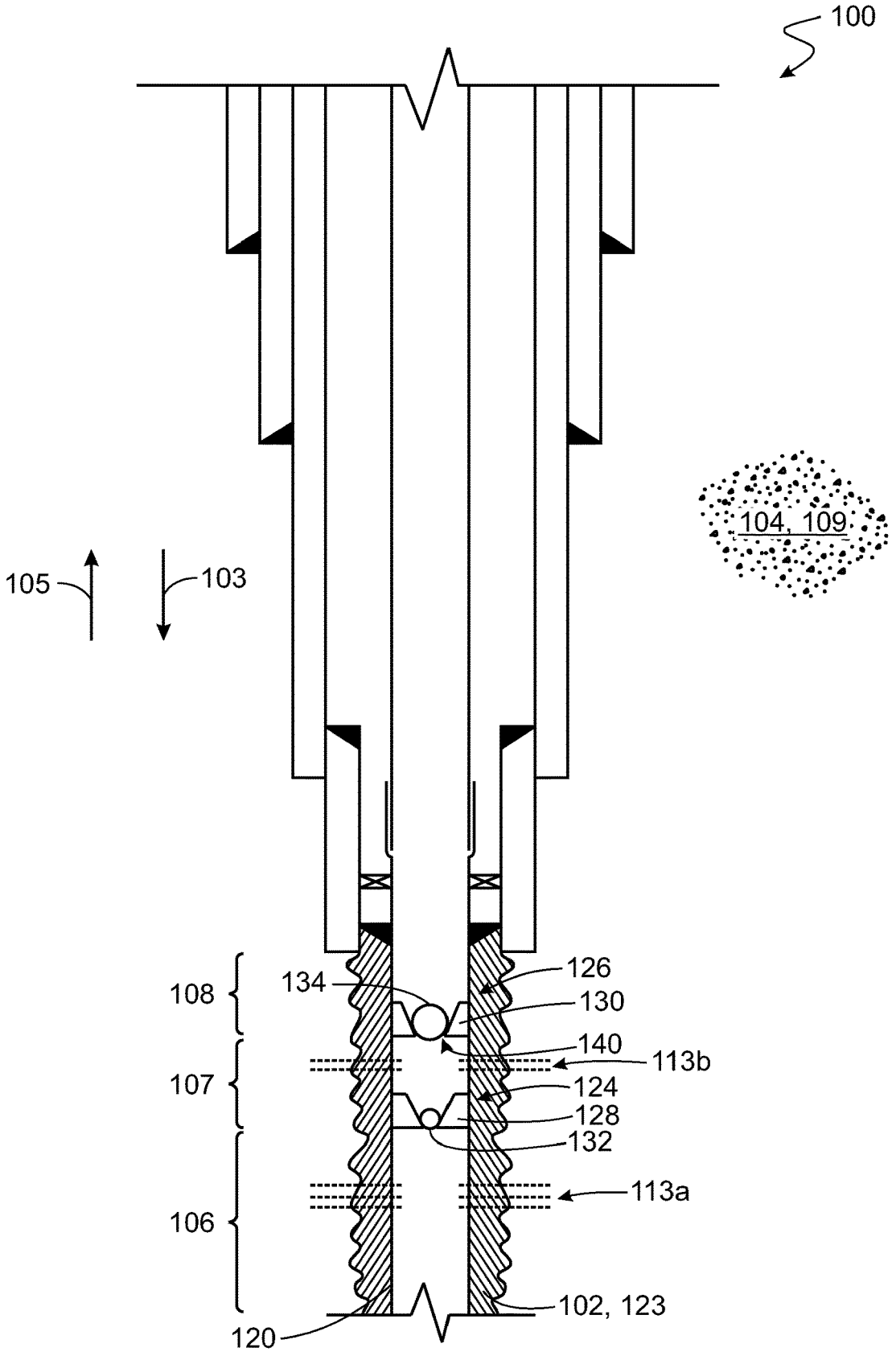

Referring to FIG. 5, treatment fluid is subsequently delivered to the production pipe 120. The treatment fluid passes through the seat 130 to reach the second stage 107, where the treatment fluid enhances productivity and connectivity to the formation 104 via the access ports 113*b*. The treatment fluid is prevented (e.g., blocked) from reaching the first stage 106 by the plugged isolation mechanism 124. The treatment fluid facilitates flowing of the formation fluid 109 toward the access ports 113*b* so that the formation fluid can be drained from the formation 104 into the production pipe 120 to substantially fill the production pipe 120 along the second stage 107. A stage such as the example second stage 107 is typically stimulated over a period of about 2 h to about 6 h, depending on a temperature within the wellbore 102, a pumping rate of the treatment fluid, and a tightness of the formation 104 with respect to permeability of the formation 104. Once stimulation of the second stage 107 has been completed, the ball 134 is delivered to the production pipe 120 to isolate the second stage 107 from the third stage 108. For example, the ball 134 abuts and seals (e.g., plugs) the opening 140 in the seat 128. The seated ball 134 provides a barrier within the production pipe 120 between the second and third stages 107, 108.

Figure 6:
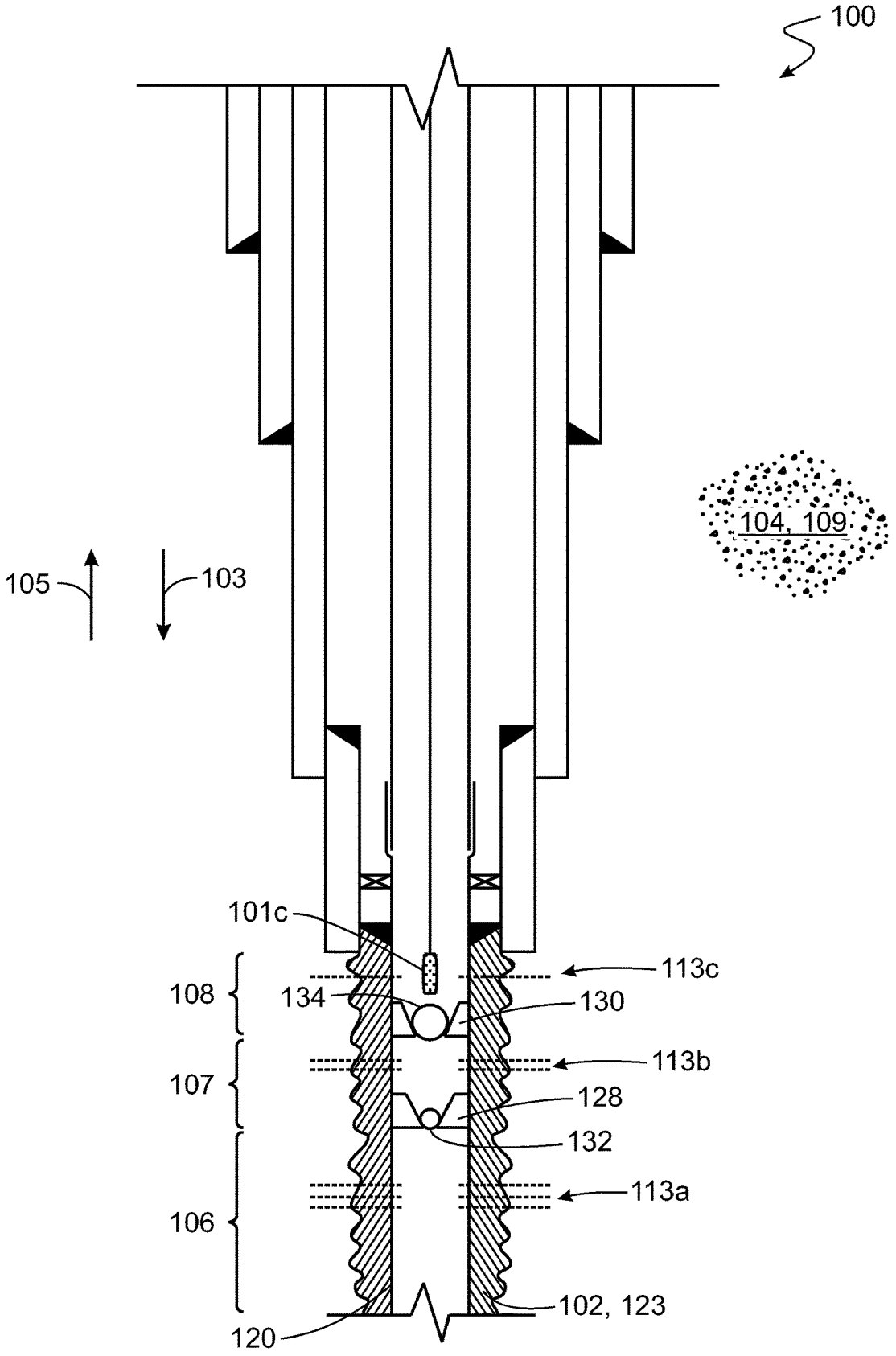

Referring to FIG. 6, stimulation of the third stage 108 can begin. A perforation tool 101*c* may be delivered to the production pipe 120 on a wireline or coiled tubing. The perforation tool 101*c* is activated to perforate (e.g., form holes in) the wall of the production tube 120, the cement 123, and the formation 104 to form one or more access ports 113*c* (e.g., indicated by dashed lines) by which formation fluid 109 can flow into the production pipe 120 along the third stage 108. In this manner, the perforation tool 101*c* is operated to fluidically connect the production pipe 120 to the rock formation 104. The perforation tool 101*c* is then removed (e.g., withdrawn) from the production pipe 120.

Figure 7:
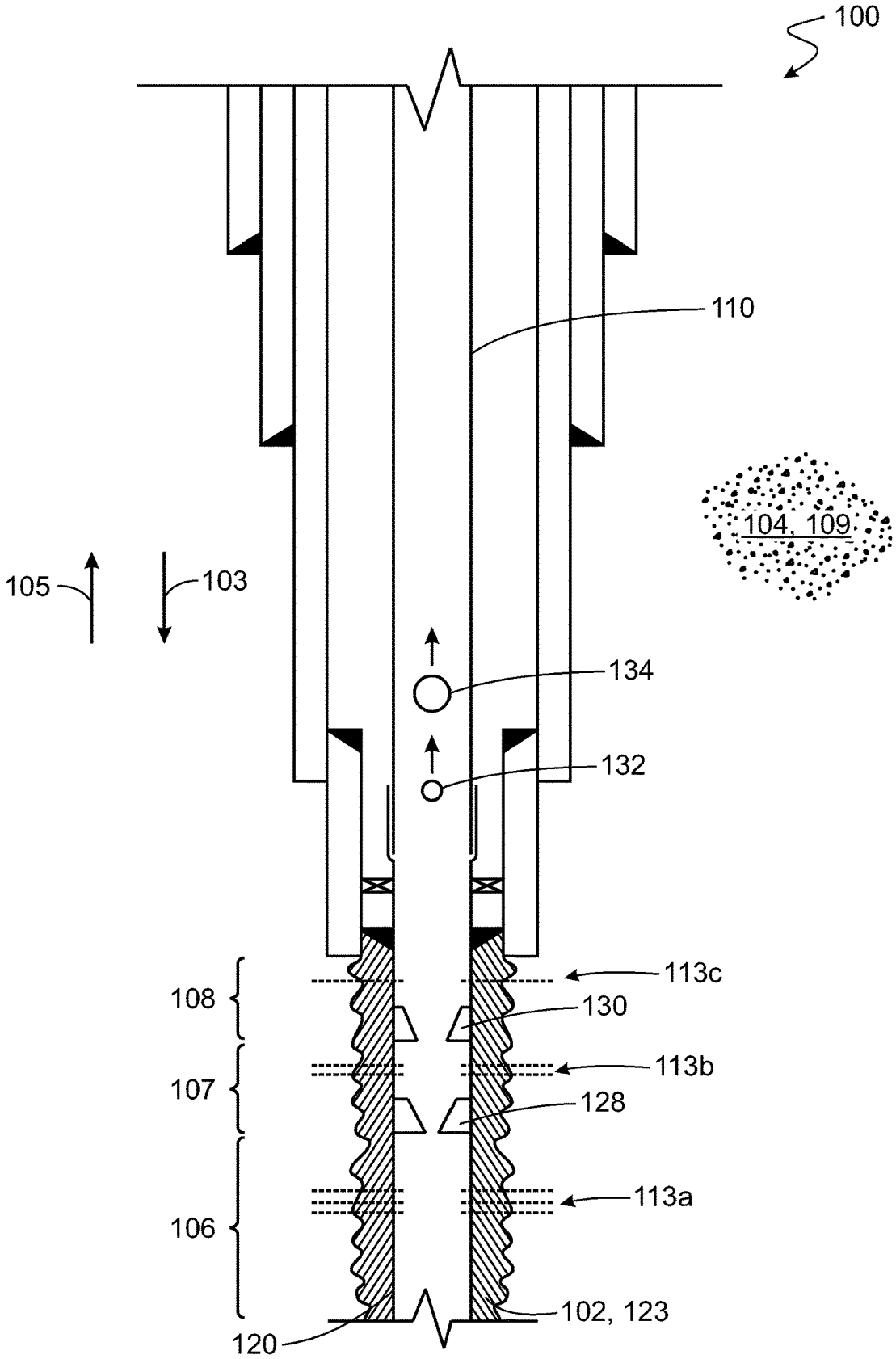

Referring to FIG. 7, treatment fluid is subsequently delivered to the production pipe 120. The treatment fluid reaches the third stage 108, where the treatment fluid enhances productivity and connectivity to the formation 104 via the one or more access ports 113*c*. The treatment fluid is prevented (e.g., blocked) from reaching the second stage 107 by the plugged isolation mechanism 126. The treatment fluid facilitates flowing of the formation fluid 109 toward the one or more access ports 113*c* so that the formation fluid can be drained from the formation 104 into the production pipe 120 to substantially fill the production pipe 120 along the third stage 108. A stage such as the example third stage 108 is typically stimulated over a period of about 2 h to about 6 h, depending on a temperature within the wellbore 102, a pumping rate of the treatment fluid, and a tightness of the formation 104 with respect to permeability of the formation 104. Once stimulation of the third stage 108 has been completed, the production pipe 120 is flowed in the uphole direction 105 such that a fluid pressure of the formation fluid 109 within the production pipe 120 forces (e.g., lifts) the balls 132, 134 from the respective seats 128, 130 to flow the balls 132, 134 to the surface.

Utilizing the isolation mechanisms 124, 126 in combination with a perforation tool within a cemented production pipe advantageously allows multi-stage fracturing of a formation without the need for bridge plugs (e.g., interior isolation plugs with an outer diameter that is about equal to an inner diameter of a production pipe) that close (e.g., plug) the production pipe across its entire cross-sectional (e.g., flow-through) area. Eliminating bridge plugs avoids failures that sometimes result at such plugs. Eliminating bridge plugs also alleviates the need to mill such bridge plugs within a production pipe (e.g., which would be required to flow them back to the surface from the production pipe) and accordingly avoids the associated time, cost, and equipment deployment. Utilizing the isolation mechanisms 124, 126 in combination with a perforation tool within a cemented production pipe also advantageously allows multi-stage fracturing of a formation without the need for frac ports and without the need for packers that would otherwise need to be installed to the outside of the production pipe to isolate the serial wellbore stages from each other.

Figure 8:
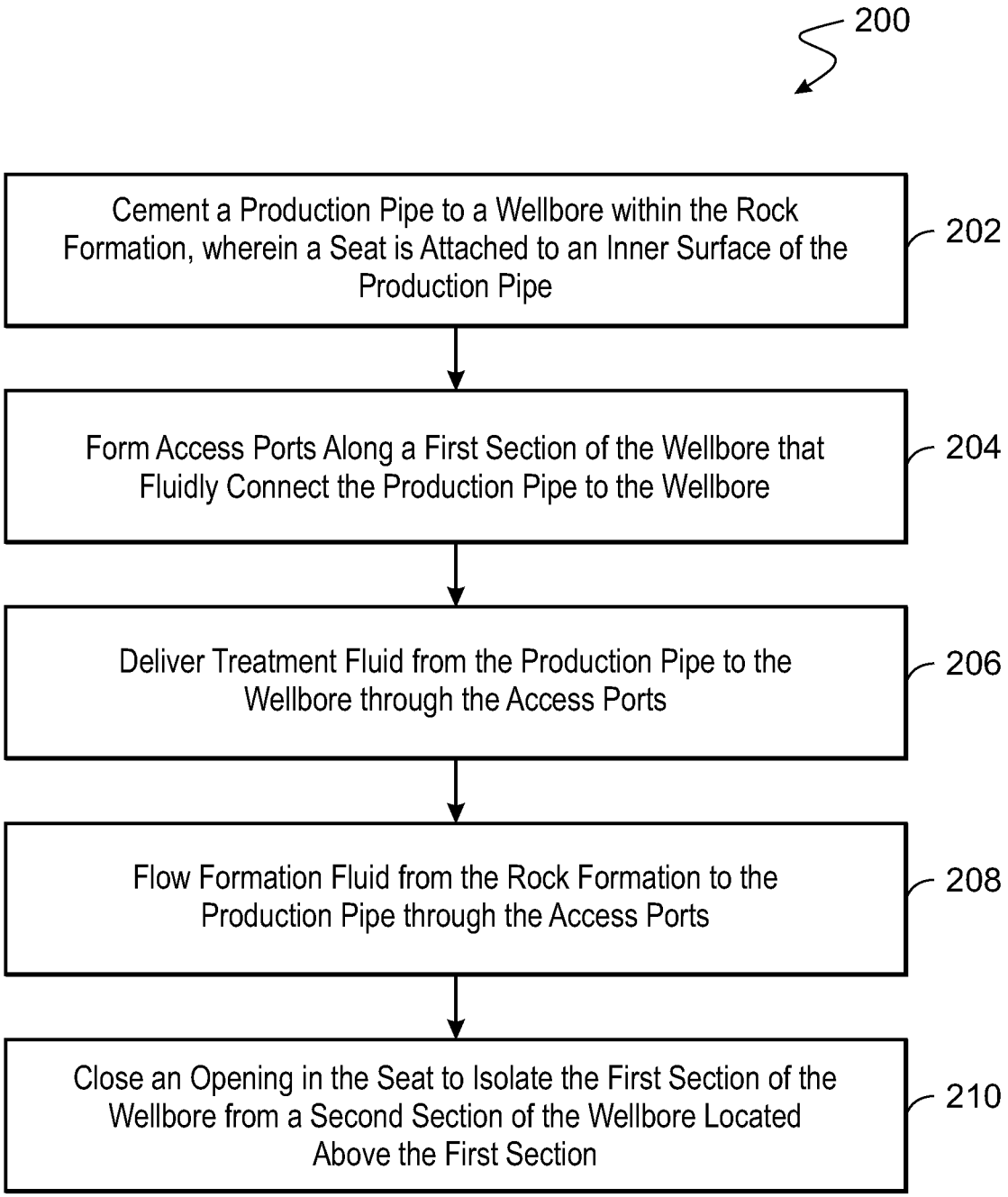
FIG. 8 is a flow chart illustrating an example method of fracturing a rock formation utilizing the well completion system of FIGS. 1-7.

FIG. 8 is a flow chart illustrating an example method 200 (for example, a multi-stage fracturing process) of fracturing a rock formation (for example, the formation 104). In some embodiments, the method 200 includes a step 202 for cementing a production pipe (e.g., the production pipe 120) to a wellbore (e.g., the wellbore 102) within the rock formation, wherein a seat (e.g., the seat 128) is attached to an inner surface of the production pipe. In some embodiments, the method 200 includes a step 204 for forming access ports (e.g., the access ports 113*a*) along a first section (e.g., the first stage 106) of the wellbore that fluidly connect the production pipe to the wellbore. In some embodiments, the method 200 includes a step 206 for delivering treatment fluid from the production pipe to the wellbore through the access ports. In some embodiments, the method 200 includes a step 208 for flowing formation fluid (e.g., the formation fluid 109) from the rock formation to the production pipe through the access ports. In some embodiments, the method 200 includes a step 210 for closing an opening (e.g., the opening 138) in the seat to isolate the first section of the wellbore from a second section (e.g., the second stage 107) of the wellbore located above the first section.

While the well completion system 100 has been described and illustrated with respect to certain dimensions, sizes, shapes, arrangements, materials, tools, and methods 200, in some embodiments, a well completion system that is otherwise substantially similar in construction and function to the well completion system 100 may include one or more different dimensions, sizes, shapes, arrangements, configurations, and materials or may be utilized with different well tools or according to different methods. For example, while a multi-stage fracturing process has been described and illustrated with respect to a production pipe 120 that is equipped to operate in a wellbore with three stages 106, 107, 108, in some embodiments, the process may be carried out using a production pipe that is equipped to operate at a well that has more than three or less than three stages according to the sequential steps discussed above with respect to FIGS. 1-7.

While a multi-stage fracturing process has been described and illustrated above with the use of three different perforation tools 101*a*, 101*b*, 101*c* along the first, second, and third stages 106, 107, 108, in some embodiments, the process may be carried out using the same perforation tool along two or more stages of a wellbore. Accordingly, other embodiments are also within the scope of the following claims.

What is claimed is:

1. A method of fracturing a rock formation, the method comprising:

deploying a production pipe to a wellbore within the rock formation for flowing formation fluid through the production pipe to a surface of the rock formation, wherein a seat is attached to an inner surface of the production pipe;

cementing the production pipe to the wellbore with cement to isolate a first section of the wellbore from a second section of the wellbore along an outer surface of the production pipe, wherein the second section is located above the first section;

deploying a perforation tool to the production pipe along the first section of the wellbore;

activating the perforation tool to form access ports along the first section of the wellbore that fluidly connect the production pipe to the wellbore;

delivering treatment fluid from the production pipe to the wellbore through the access ports;

flowing formation fluid from the rock formation into the production pipe through the access ports; and closing an opening in the seat to isolate the first section of the wellbore from the second section of the wellbore.

2. The method of claim 1, wherein the seat is positioned between the first and second sections of the wellbore.

3. The method of claim 1, further comprising withdrawing the perforation tool from the production pipe.

4. The method of claim 1, further comprising delivering the treatment fluid to the production pipe.

5. The method of claim 1, wherein the seat is a first seat, wherein a second seat is attached to the inner surface of the production pipe above the first seat, and wherein the method further comprises passing a ball through the second seat to close the opening in the first seat.

6. The method of claim 5, wherein the access ports are first access ports, and wherein the method further comprises:

forming second access ports along the second section of the wellbore that fluidly connect the production pipe to the wellbore; and delivering treatment fluid from the production pipe to the wellbore through the second access ports.

7. The method of claim 6, further comprising blocking the treatment fluid within the production pipe along the second section of the wellbore from moving downward through the seat.

8. The method of claim 6, further comprising flowing formation fluid from the rock formation to the production pipe through the second access ports.

9. The method of claim 8, further comprising flowing the formation fluid within the production pipe along the first and second sections of the wellbore upward to the surface of the rock formation.

10. The method of claim 9, further comprising flowing the ball upward from the seat to the surface.

11. The method of claim 8, wherein the opening is a first opening, and wherein the method further comprises closing a second opening in the second seat to isolate the second section of the wellbore from a third section of the wellbore located above the second section.

12. The method of claim 11, wherein the second opening is wider than the first opening.

13. The method of claim 11, wherein the ball is a first ball, and wherein the method further comprises closing the second opening in the second seat with the second ball.

14. The method of claim 1, further comprising isolating the first section from the second section without employing a packer on the outer surface of the production pipe.

15. The method of claim 1, further comprising isolating the first section from the second section without employing a bridge plug within the production pipe.

* * * * *